US005284100A

United States Patent [19]

Thorn

[11] Patent Number: 5,284,100

[45] Date of Patent: Feb. 8, 1994

[54] FOLDING TABLE SYSTEM AND APPARATUS

[75] Inventor: William M. Thorn, Killen, Ala.

[73] Assignee: Hunt Holdings, Inc., Wilmington, Del.

[21] Appl. No.: 830,294

[22] Filed: Jan. 31, 1992

[51] Int. Cl.[5] ..... A47B 3/00

[52] U.S. Cl. ..... 108/129; 248/345.1

[58] Field of Search ..... 108/127, 129; 248/345.1, 439

[56] References Cited

U.S. PATENT DOCUMENTS

| | | | |
|---|---|---|---|
| 1,709,928 | 4/1929 | Whitney | 108/129 X |
| 1,915,249 | 6/1933 | Jorgensen | 248/345.1 |
| 2,889,185 | 6/1959 | Heisler . | |
| 3,094,080 | 6/1963 | Shannon | 108/129 |
| 3,408,965 | 11/1968 | Hamilton et al. . | |
| 3,604,372 | 9/1971 | Hewett | 108/160 |
| 3,709,159 | 1/1973 | Oglesby, Jr. | 108/129 X |
| 3,907,118 | 9/1975 | Pelavin | 248/345.1 X |
| 4,064,815 | 12/1977 | Baum | 108/129 |
| 4,471,969 | 9/1984 | Zabalia et al. | 108/129 X |
| 4,565,021 | 1/1986 | Kay et al. | 248/439 X |
| 4,727,816 | 3/1988 | Virtue | 108/91 |
| 4,735,392 | 4/1988 | Farmer | 248/439 |

FOREIGN PATENT DOCUMENTS

| | | | |
|---|---|---|---|
| 1100664 | 9/1955 | France | 108/129 |
| 1178108 | 5/1959 | France | 248/345.1 |
| 1120651 | 12/1961 | France | 108/127 |
| 1404660 | 5/1965 | France | 248/345.1 |
| 2461881 | 3/1981 | France | 248/439 |

*Primary Examiner*—Peter M. Cuomo
*Assistant Examiner*—Michael J. Milano
*Attorney, Agent, or Firm*—Synnestvedt & Lechner

[57] ABSTRACT

The folding leg structure of a folding table is journalled for rotation in a cylindrical journal formed in a bracket which is bent-up from a strip of metal and secured to the bottom of a table. A downwardly-extending portion of the bracket has a flat horizontal surface containing an aperture in which a resilient bumper member having a high-friction surface is held. Four such brackets are used, one near each corner of the table, and the bumpers extend downwardly beyond all other portions of the table, when in its folded condition, so that a plurality of such tables can be stacked with the top of each table top contacted only by the bumpers of an adjacent folded table, thus avoiding marring and sideways slippage. An additional bracket and bumper may be mounted near the center of the underside of the table for additional support.

5 Claims, 2 Drawing Sheets

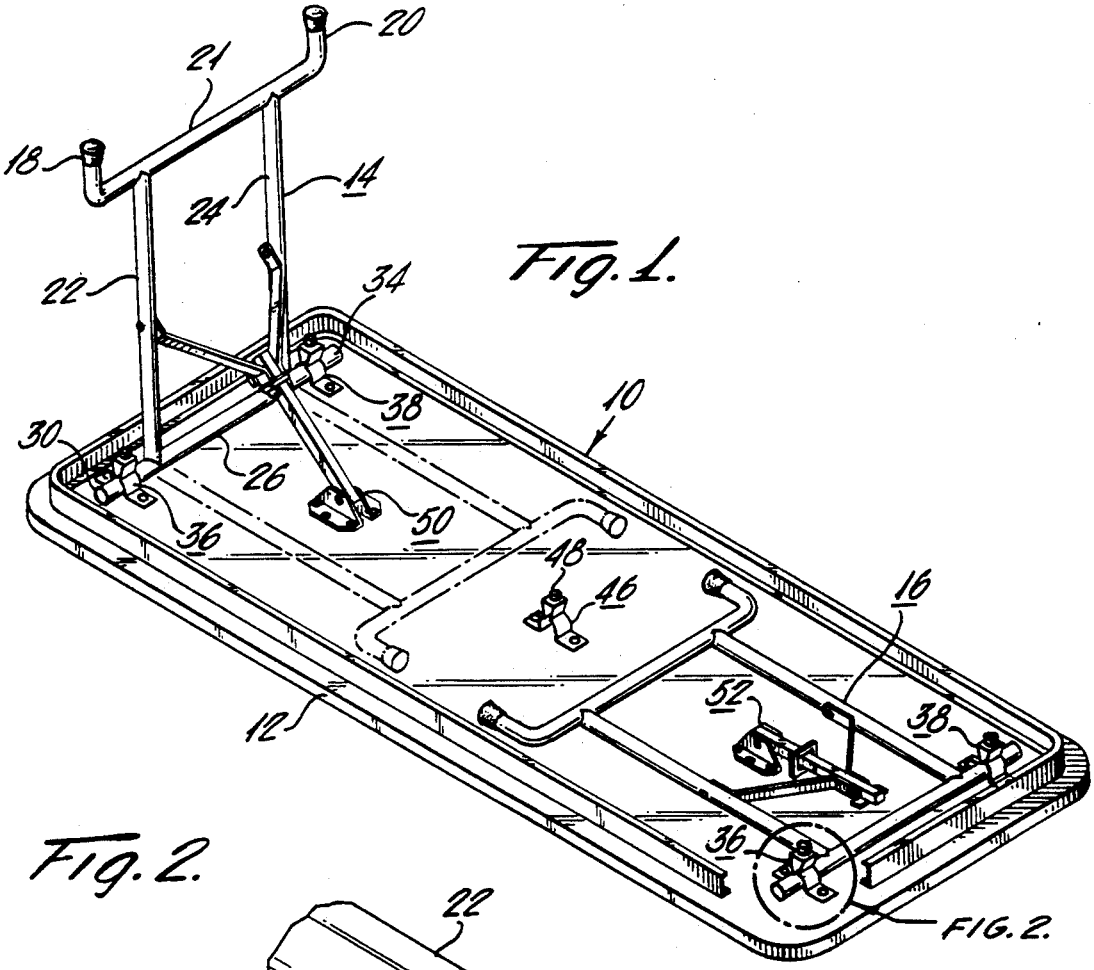
Fig. 1.
Fig. 2.
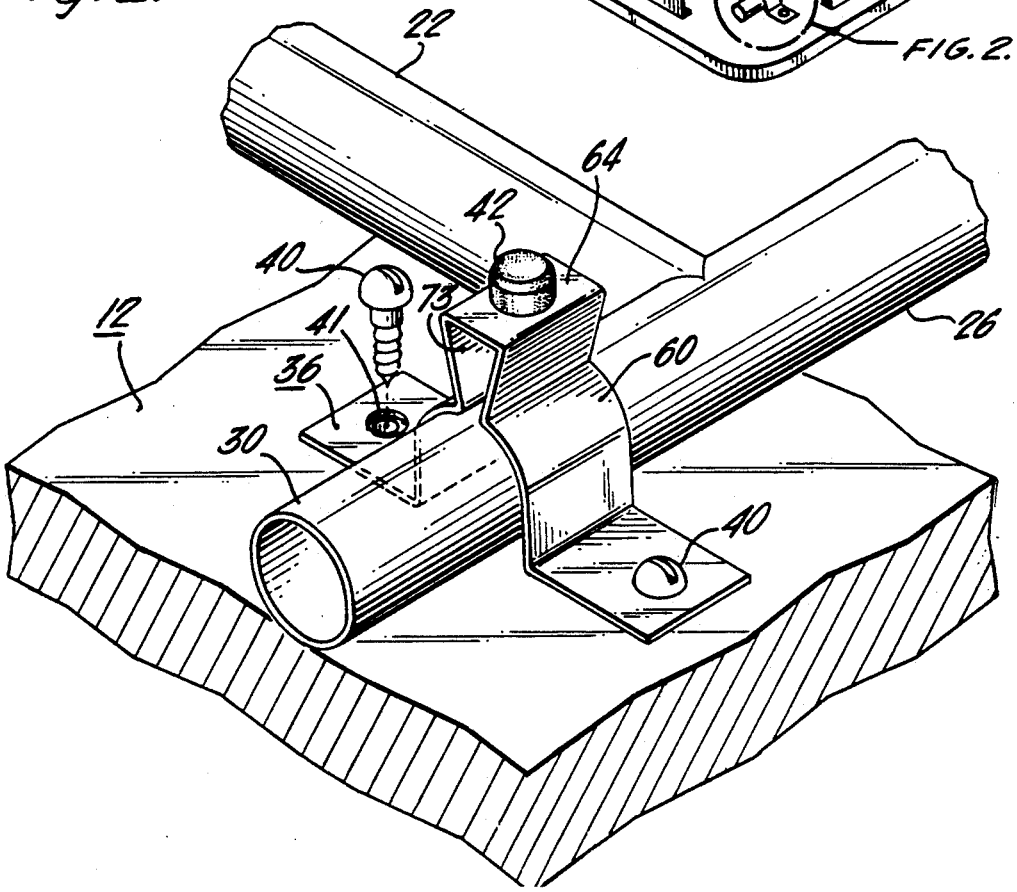

FOLDING TABLE SYSTEM AND APPARATUS

FIELD OF THE INVENTION

This invention relates to a system and apparatus for supporting a table top on a foldable leg structure, and for providing secure, substantially mar-proof contact to other structures which the table may contact when it is folded and stored.

BACKGROUND OF THE INVENTION

Folding tables are known in which one or more, usually four, legs are foldably mounted to the underside of a table; card tables are usually of this general type, as are banquet or picnic tables designed to be put up and taken down frequently. Many mechanisms are known for providing the desired folding action; these are often rather complex and expensive. One simple, inexpensive system for these purposes provides a horizontal shaft to which one end of the leg structure is secured, which shaft is journalled in a simple band secured to the underside of the table. Appropriate over-center devices may be used with such a journal-mounted system to lock the leg structure in its folded and unfolded positions.

It is also known to provide one or more "bumpers", usually four, which extend downwardly with respect to the underside of the table top, to contact another table or other structure which the table may bear against when not in use. For example, when such tables are folded and stacked on top of each other, they will then only be contacted by the bumpers of other tables, thus minimizing marring; in addition, in some cases the bumpers are of high-friction elastomeric material so as to restrain relative lateral motion of the tables when stacked, thus contributing to the stability of the stack, especially when the stack is moved about. In many cases the bumpers are located on the corners of the frame of the table. In U.S. Pat. No. 3,604,372 of O. C. Hewett there is shown use of a finger pad on each movable strut of a rather complicated pivot structure used in folding and unfolding the four table legs; while this is not its primary function, the finger pad can be used as a "bumper".

While operative for their basic purposes, such arrangements of the prior art have involved relatively complex and expensive apparatus for providing the requisite folding and bumpering functions.

It is an object of the present invention to provide apparatus which provides for the folding and unfolding of the legs of a table and which provides the desired protection against marring and sideways slippage as well, while being especially simple and inexpensive to make and assemble.

SUMMARY OF THE INVENTION

These and other objects of the invention are achieved by the provision of new and useful apparatus for mounting the foldable leg structure of a table to the underside of a table top, and for providing bumper protection against contact with other structures located adjacent to the table, which apparatus comprises bracket means comprising a band secured to the underside of the table and forming a horizontal, generally cylindrical journal in which a horizontal shaft secured to the leg structure can be journalled to permit folding and unfolding motion of the leg structure; the bracket is specially shaped to receive a bumper which extends downwardly and away from the table top, beyond the position of any other parts of the table assembly when in its folded condition. Preferably the bumper has a high-friction surface, and in a preferred form is of an elastomer, to oppose tendencies for the table to slide sideways when stacked and prevents marring of surfaces of the next table in the stack. Such sideways slippage is especially troublesome when a large number of the tables are stacked on a dolly or hand-truck, and moved over rough terrain.

In a preferred form, the band-like bracket has a downwardly-protruding flat portion on its downwardly-facing side containing an aperture into which the bumper can be press-fitted, with a space between the aperture and the horizontal shaft in the bracket into which the inserted bumper portion extending, without encountering the shaft journalled in the bracket; the bumper is preferably provided with a circumferential groove in which the edges of the bracket aperture fit, to retain the bumper securely in the desired position.

In an especially preferred embodiment wherein the table top has a relatively large area, a bracket and bumper of the type described are also mounted on a central portion of the underside of the table top, to provide additional support when the tables are stacked.

The bracket itself is very inexpensive to make and install, and adding the bumper to it increases the cost of the bracket only very slightly.

BRIEF DESCRIPTION OF FIGURES

These and other objects and features of the invention will become more apparent from a consideration of the following detailed description, taken with the accompanying drawings, in which:

FIG. 1 is a perspective view of the underside of a table with folding leg structures, constructed in accordance with the invention,with one leg structure in the folded position and one in the unfolded or erected position;

FIG. 2 is an enlarged fragmentary perspective view of the portion of the bracket and bumper shown within the dotted circle in FIG. 1;

DETAILED DESCRIPTION OF PREFERRED EMBODIMENT

Figure 3:
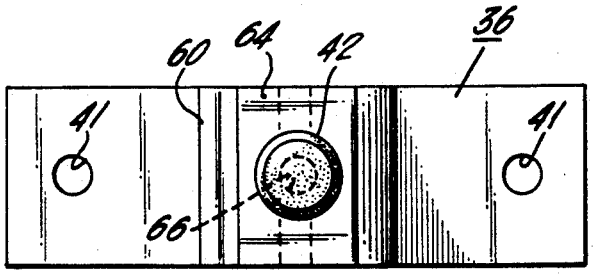
FIGS. 3 and 4 are, respectively, a top plan view and a side elevational view of the bracket and bumper of FIG. 2.

Referring now to the embodiment of the invention shown in the drawings by way of example only, FIG. 1 shows a table 10 comprising a table top 12 and two leg structures 14 and 16 mounted to the bottom of the table top. The structures 14 and 16 are identical, although facing oppositely, hence only one need be described in detail.

Leg structure 14 comprises a pair of feet 18 and 20 joined by arched member 21, to which they are appropriately secured as by welding (not shown). The arched member 21 is secured to the lower ends of a pair of parallel side rails 22 and 24, which in turn are secured to each other at their opposite ends by a shaft 26 in the form of a cross-piece, secured to the ends of the side rails by any appropriate fasteners, such as rivets or a weld. The ends of the cross-piece, in this example, extend beyond the side rails, as at 30 and 34, and are journalled in brackets 36 and 38 respectively. Each bracket is secured to the bottom of the table top 12 as by the two screws 40; all of the brackets shown are, in this example, identical with each other. Each bracket is provided with a bumper such as 42.

In this example, a bracket 46 and a bumper 48 are also mounted approximately at the center of the underside of the table top, with the bumper facing downwardly, to provide additional support when the tables are stacked.

The leg structures 14 and 16 are provided with respective erecting and locking mechanisms 50 and 52, which may be of known form, to hold them in their erected and folded positions.

Figure 4:
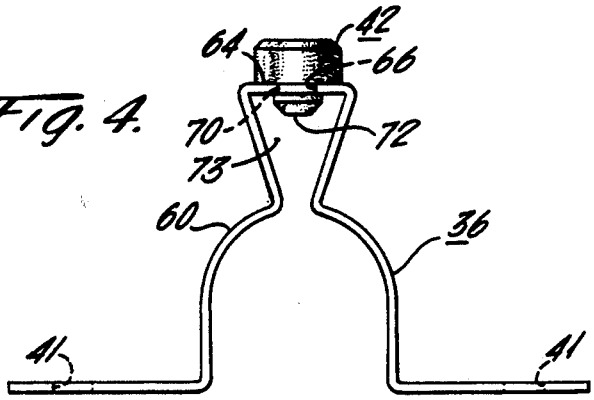

Referring especially to FIGS. 2–4, it will be seen that the bracket 36 has a central portion 60 having a generally cylindrical shape to serve as a journal for cross-piece shaft 30; the underside of the bracket, farthest from the underside of the table top, is configured to provide a downwardly-facing and downwardly-protruding flat surface 64 containing a round aperture 66 in which the bumper 42 is retained. To this end, the bumper has a circumferential groove 70 which fits tightly in the aperture 66; on both sides of the groove the bumper is larger than the recess, but it is sufficiently elastic that the tip portion 72 of the bumper can easily be pressed into position in the aperture. The bracket is shaped to provide a recess 73 into which the end of the bumpers can be inserted without being blocked by the shaft 26.

Figure 5:
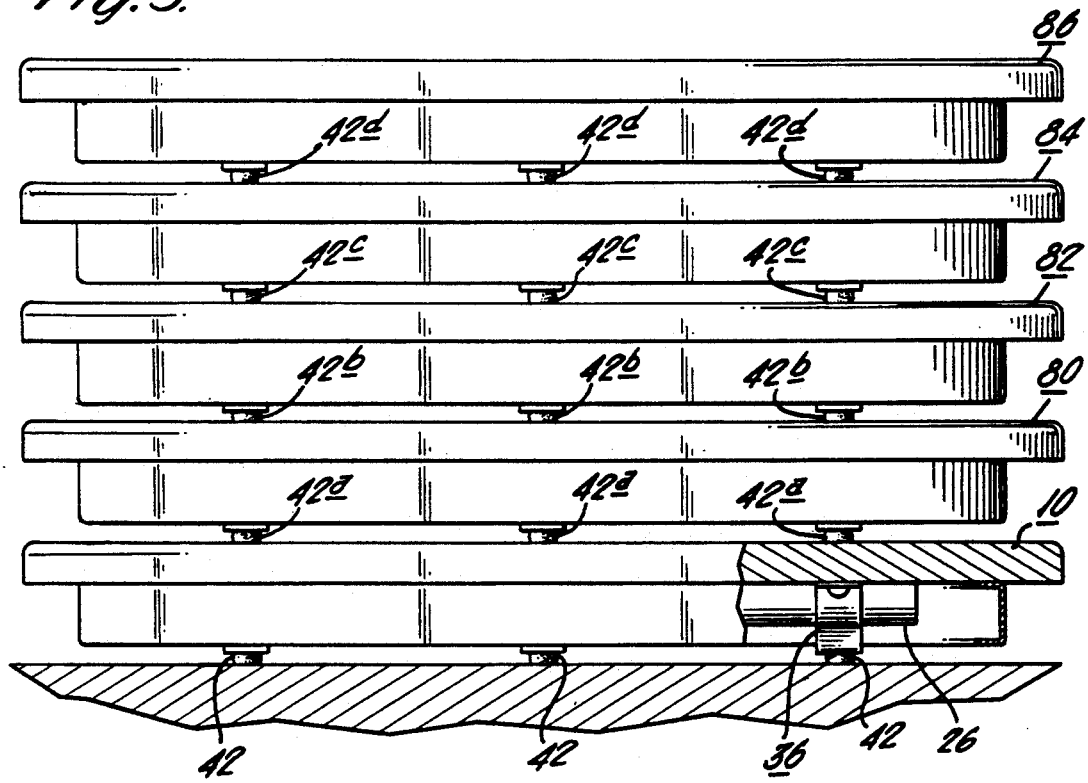
FIG. 5 is an end elevational view showing a plurality of table assemblies according to the invention, in a stacked array.

In FIG. 5 there is shown the table assembly 10 and several other table assemblies 80, 82, 84, 86 in a stacked array, as viewed from one end, with the bumpers such as 42, 42*a*, 42*b* and 42*c* and 42*d* of each table constituting the sole contact to the next table, thereby avoiding marring and minimizing sideways slippage between the stacked tables.

In a representative example, the brackets are produced by a progressive die arrangement, from 18 gage (0.048" thick) galvanized steel. The flat portion 64 and the recess 73 are formed by a first bending step, then the cylindrical portion 60 is formed by a second bending step. The diameter of the hole 66 in the bracket may be about ⅛", and the bumper is preferably an elastomer or a butyrate.

All that is necessary to make the apparatus is to stamp out the metal strip, form the mounting holes 41 and the central hole 66, and bend the strip into the shape shown in a progressive die, secure the bracket in place by means of the screws, and then push the bumper into the hole in the bracket. The bumper itself is easily molded by conventional procedures. Manufacture and assembly are therefore extremely simple and inexpensive.

While the invention has been described with particular reference to specific embodiments in the interest of complete definiteness, it will be understood that it may be embodied in a variety of forms diverse from those specifically shown and described, without departing from the spirit and scope of the invention.

What is claimed is:

1. Apparatus for foldably mounting the leg structure of a table to the underside of the top of said table, and for supporting a plurality of such tables, one above the other, in a stacked array, comprising:

bracket means comprising a band having a central portion of generally cylindrical shape providing a horizontal journal for receiving a horizontal shaft extending horizontally from one of said legs, whereby said shaft and said one leg may be rotated about the horizontal axes of said journal to fold and unfold said one leg with respect to a table top;

said bracket means also comprising a table attachment portion for securing it to the underside of said table top; and resilient bumper means having a high-friction surface, secured to the lower side of said bracket means and extending away from said table top beyond all other portions of said table, whereby said bumper contacts the adjacent table when in said stacked array;

wherein said band is provided with a substantially flat, downwardly-facing portion to which said resilient bumper means is secured; and wherein said substantially flat portion has an aperture in it, and said bumper means is provided at one end with a portion larger in diameter than said aperture but small enough in diameter to be elastically compressed and forced into said aperture, said bumper means having a circumferential groove formed in said large end portion thereof in which the edges of said band adjacent said aperture seat themselves.

2. The invention as claimed in claim 1, wherein said table attachment portion comprises at least a pair of horizontal extensions of said band each containing at least one further aperture for receiving a fastener.

3. A folding table assembly, comprising:

a table top;

at least two table legs;

a leg-support structure secured to said legs and comprising a cross-piece at its upper end;

a pair of brackets each secured to the underside of said table top and each encircling said cross-piece to provide a horizontal supporting journal therefor; and a bumper secured to the lowermost portion of each of said brackets and extending a sufficient distance therefrom as to constitute the lowermost part of said table assembly when said leg-support structure is in its folded condition;

wherein each of said bracket means comprises a band extending around said cross-piece and having portions extending horizontally beyond said cross-piece for securing said bracket means to the underside of said table top; and wherein each of said brackets has a substantially flat, horizontal portion on the underside containing an aperture for receiving said bumper.

4. The invention as claimed in claim 3, comprising another bracket like said bracket of said pair and mounted near the center of the bottom of said table top.

5. The assembly of claim 3, wherein said each bumper is of a resilient, elastomeric material having a high-friction surface.

* * * * *